US005517937A

United States Patent [19]

Lunde

[11] Patent Number: 5,517,937

[45] Date of Patent: May 21, 1996

[54] OFFSHORE TURRET SYSTEM

[75] Inventor: Peter Lunde, Westlake Village, Calif.

[73] Assignee: Imodco, Inc., Calabasas Hills, Calif.

[21] Appl. No.: 398,651

[22] Filed: Mar. 3, 1995

[51] Int. Cl.[6] ..... B63B 21/04; B63B 21/18; B63B 21/50

[52] U.S. Cl. ..... 114/230; 114/293; 114/180; 114/179

[58] Field of Search ..... 114/293, 179, 114/230, 180; 441/3–5; 166/352–355

[56] References Cited

U.S. PATENT DOCUMENTS

| | | | |
|---|---|---|---|
| 3,261,039 | 7/1966 | Koppenol | 441/5 |
| 3,264,662 | 8/1966 | Young . | |
| 3,366,982 | 2/1968 | Sutton | 441/5 |
| 3,590,407 | 7/1971 | Bratianu | 114/230 |
| 3,735,435 | 5/1973 | Mikulicic . | |
| 3,945,066 | 3/1976 | Davies | 114/230 |
| 4,254,523 | 3/1981 | Kentosh | 114/230 |
| 4,305,341 | 12/1981 | Stafford | 114/230 |
| 4,406,636 | 9/1983 | Heijst | 441/5 |
| 4,601,252 | 7/1986 | Wuttudal | 114/230 |
| 4,698,038 | 10/1987 | Key . | |
| 4,892,495 | 1/1990 | Svensen | 441/5 |
| 5,113,778 | 5/1992 | Paasche | 114/256 |
| 5,288,253 | 2/1994 | Urdshals | 441/5 |
| 5,419,398 | 5/1995 | Askestad | 166/355 |

FOREIGN PATENT DOCUMENTS

| | | | |
|---|---|---|---|
| 50096 | 3/1985 | Japan | 114/293 |
| 9307048 | 4/1993 | WIPO . | |

*Primary Examiner*—Sherman Basinger
*Attorney, Agent, or Firm*—Freilich Hornbaker Rosen

[57] ABSTRACT

A turret that is rotatably mounted on a vessel and connected to risers extending down to sea floor wells, is constructed so the turret is of moderate diameter to enable the use of a moderate size bearing and moderate weight turret, while providing room around the terminations of the upper ends of the risers. The risers (46A, 46G, FIG. 3 ) extend through tubes (62, 70, 72) which are oriented at an angle to the turret axis (22), so the lower ends of the tubes lie on large diameter circles to be considerably spaced apart, while the upper ends of the tubes are closer together to fit within the inside of the moderate sized bearing (60). The upper ends of the risers may be terminated at a plurality of different levels (90, 92, 94) within the turret to provide room around each termination.

13 Claims, 5 Drawing Sheets

OFFSHORE TURRET SYSTEM

BACKGROUND OF THE INVENTION

One type of offshore production system includes a turret that lies within a cavity of a vessel, within the vessel hull or an extension thereof, the turret being moored by centenary chains and being connected through largely vertical risers that extend down to wells at the sea floor. The upper ends of those risers that carry fluids such as oil or gas, are connected through a fluid swivel at the top of the turret, to the vessel to deliver liquid and/or gaseous hydrocarbons to storage tanks in the vessel. A bearing structure consisting of one or more bearings rotatably connects the turret to the vessel, to allow the turret to avoid rotation while the vessel weather-vanes around the turret (changes direction with changing winds, waves, and currents).

In prior systems which used a small number of risers, the turret could be designed so the risers extended up through a few vertical tubes. However, where a large number of risers must be accommodated, that extend from a plurality of wells, it is difficult to design an appropriate turret. It is theoretically possible to use a turret of very large diameter to provide a work area of about one meter between the upper ends of the risers. However, such turret of very large diameter would be heavy and costly and take up an appreciable portion of the vessel hull which otherwise could accommodate oil, as well as possibly requiring a vessel with a wider hull. A very important practical problem is that it is not presently possible to obtain bearings of more than about eight meters diameter. This is because very large equipment is used to forge and machine continuous raceways for the bearings, and applicant does not know of any source in the world which can supply larger precision bearings.

SUMMARY OF THE INVENTION

In accordance with one embodiment of the present invention, an offshore hydrocarbon production system is provided for use with a number of sea floor wells and a corresponding number of risers extending up to a turret. The turret is of moderate size and weight and is mounted on the vessel by a bearing structure of moderate diameter, while providing considerable working area around the upper end of each of a large number of risers. The risers extend through largely vertical tubes whose upper ends lie at deck structures that are vertically spaced from one another. With only a fraction of the total number of risers terminating at each deck structure level, a wide area can be easily left around the termination at the upper end of each riser and tube for workmen to work in. The tubes preferably extend at an angle to the turret axis so that lower ends of the tubes lie on an imaginary circle of a larger diameter than the inside of the turret bearing structure, while upper ends of the tubes lie within a circle that is smaller than the inside of the bearing structure. The lower ends of the tubes extend about parallel to upper portions of the risers in the quiescent vessel position.

The novel features of the invention are set forth with particularity in the appended claims. The invention will be best understood from the following description when read in conjunction with the accompanying drawings.

DESCRIPTION OF THE PREFERRED EMBODIMENT

Figure 1:
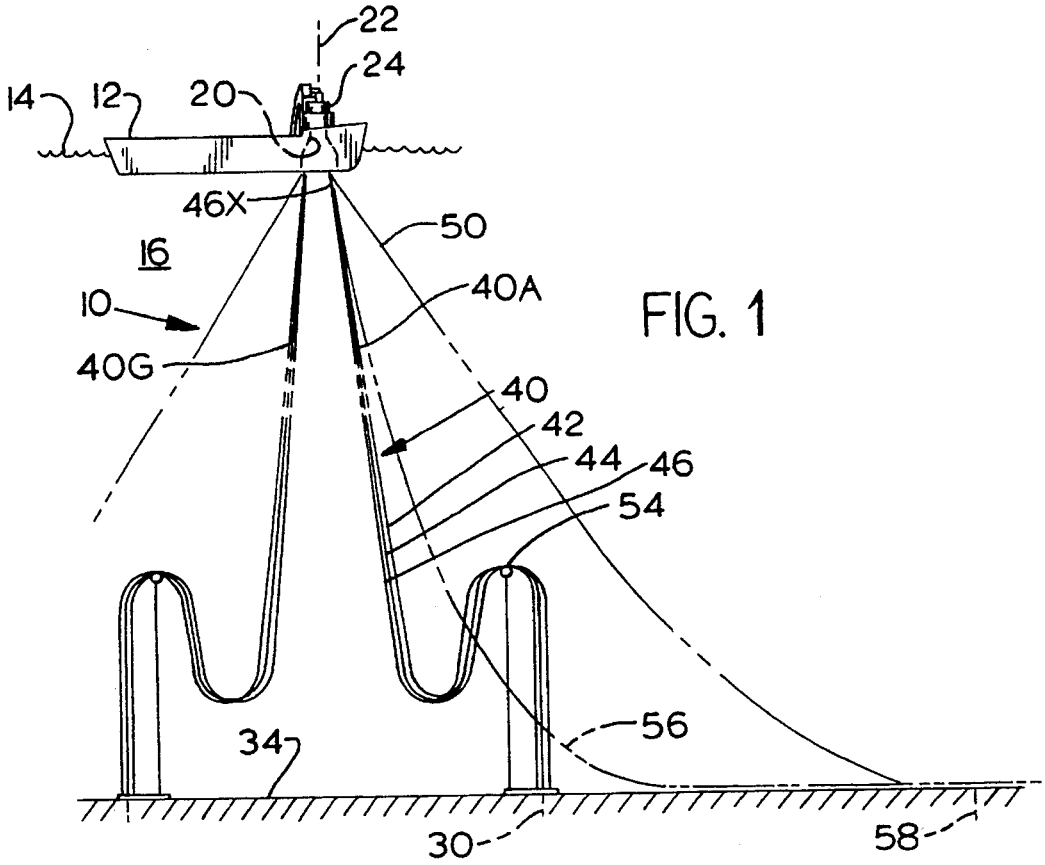
FIG. 1 is a partial side elevation view of an offshore hydrocarbon production system constructed in accordance with the present invention.

FIG. 1 illustrates an offshore hydrocarbon production system 10 which includes a vessel 12 that floats at the sea surface 14 of a sea 16. The vessel has a cavity 20 extending along a vertical axis 22, and a turret 24 is rotatably mounted in the cavity. The system is designed to produce hydrocarbons from each of a plurality of sea floor wells 30 that extend below the sea surface 34. In this system there is a set 40 of risers that includes three risers 42, 44, 46 extending from each undersea well up to the turret. Risers 42 are production risers that carry oil and gas up to the turret, risers 44 are annulus risers that carry fluids to be injected into the wells, while risers 46 are umbilical risers that carry electrical or hydraulic lines. The turret is moored by a group of mooring chain devices 50 which extend in different directions to the sea floor. The particular set 40 of risers is shown having a lower portion extending in a loop at a deep undersea buoy 54. The figure also shows, in phantom lines, an alternative riser 56 which extends in a catenary curve to the sea floor and along the sea floor to a well at 58. In both cases, the upper ends such as 46X of the risers, extend at an angle of a plurality of degrees from the vertical. The vessel 12 is shown in its quiescent position, which it assumes in calm weather.

Figure 2:
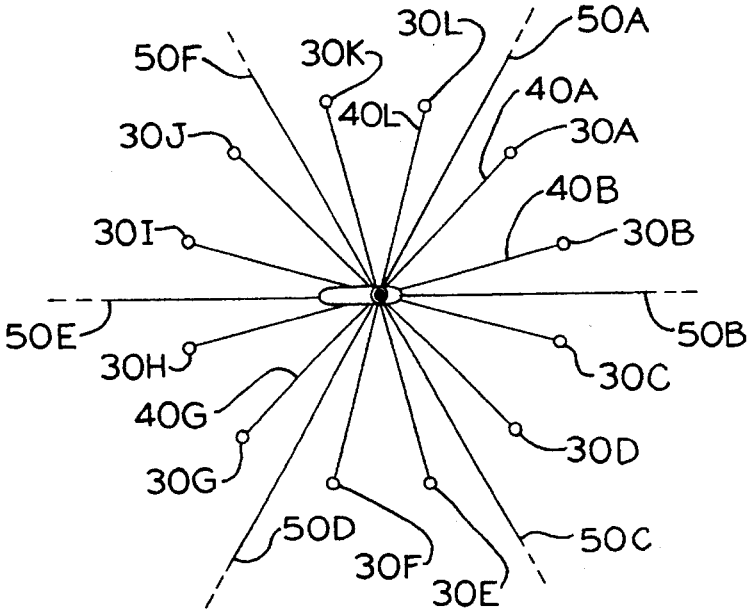
FIG. 2 is a plan view of the production system of FIG. 1.

FIG. 2 shows that the particular system include six mooring chain devices 50A–50F and twelve sea floor wells 30A–30L. The system includes twelve sets of risers 40A–40L that each has three risers, for a total of thirty-six risers. The turret must securely connect to each of the six mooring chain devices 50 and to each of the thirty-six risers.

Figure 3:
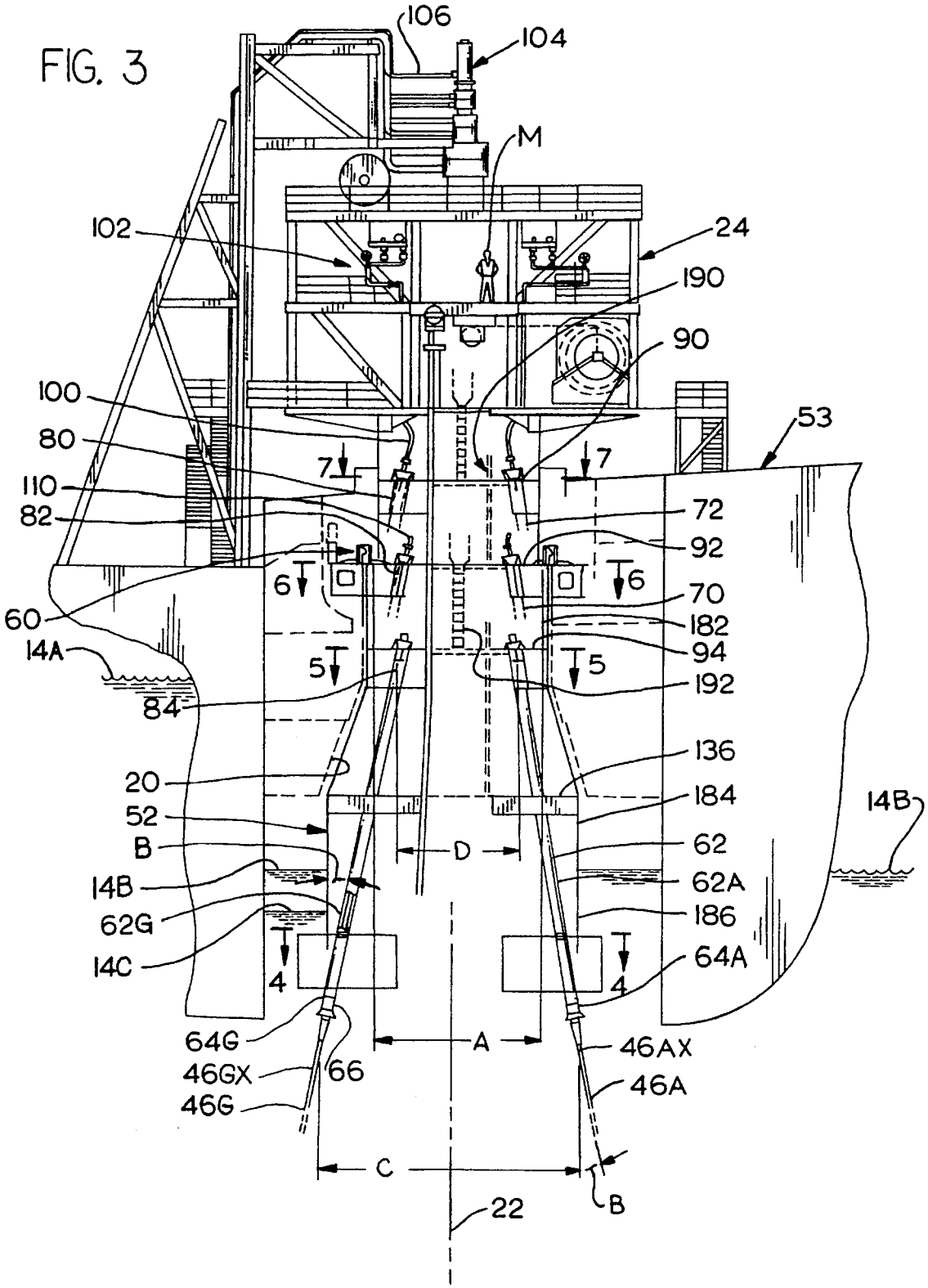
FIG. 3 is a sectional side view of the turret of the production system of FIG. 1, with the vessel in its quiescent position.

FIG. 3 is a sectional view of the turret 24. The turret includes a frame 52 that is rotatably mounted on the vessel hull 53 by a bearing assembly or structure 60 which has an inside diameter A such as seven meters. The particular bearing 60 has three sets of rollers that roll on three pairs of raceways, to provide two horizontal and one vertical bearing. Each of the umbilical risers such as 46A has an upper end 46AX that extends through a long primarily vertically extending umbilical tube 62, which extends at an angle B to the vertical direction of the turret axis 22, so that progressively higher locations along the tube lie progressively closer to the axis. As a result, the distance C between the lower ends 64A, 64G of the tubes can be much greater than the distance D between their upper ends (which is measured between the tube locations farthest from the axis). The lower ends 66 of the twelve umbilical tubes for the twelve wells, are all located substantially on an imaginary circle having a diameter C which is much larger than the inside diameter A of the bearing structure 60.

A second group of tube elements or tubes 70 are annulus tubes which enclose annulus risers through which chemicals, etc. can be injected into the wells. The lower ends of the these tubes lie substantially on the imaginary circle of diameter C (actually on a circle of slightly smaller diameter) and the upper ends of these tubes 70 lie on an imaginary circle of diameter D which is less than the inside diameter of the bearing structure. A third group of tubes 72 are production tubes that carry largely hydrocarbons (liquid and/or gaseous). Their lower ends lie on an imaginary circle of substantially the diameter C (actually, somewhat smaller than C), and their upper ends lie on an imaginary circle of the diameter D.

It can be seen that the upper ends 80, 82, 84 of the three sets of tubes lie at different heights, which are the heights of three different deck structures or decks 90, 92, and 94 of the turret frame. The upper ends 80 of tubes 72 that are terminated at the first or uppermost deck 90, are connected through pipes 100 that pass through a group of valves, chokes, and other equipment 102 and are delivered to a fluid swivel 104 that is mounted at the upper end of the turret. A group of pipes or ducts 106 connect rotatable parts of the fluid swivel to other conduits leading to processing equipment and to tanks on the vessel where the hydrocarbons are stored or otherwise disposed of (for gas). The upper ends 82 of the second group of tubes 70 are connected through other pipes 110 that may connect through the fluid swivel to injectable fluid sources on the vessel. The upper ends of the umbilical tubes extend to electrical cables, or lines, or hydraulic lines.

Figure 4:
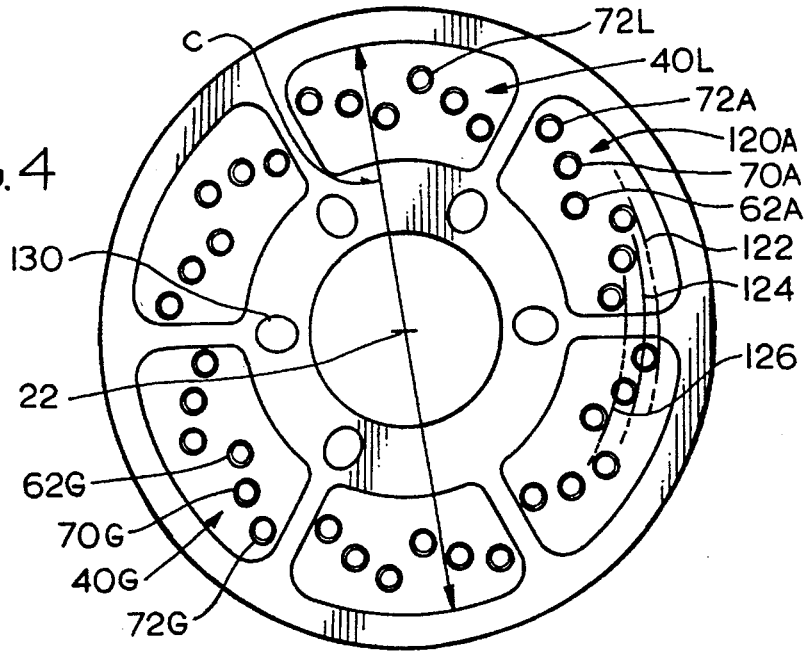
FIG. 4 is a simplified sectional view taken on line 4—4 of FIG. 3.

As shown in FIG. 4, each set of tubes such as set 120A that includes tubes 64A, 70A, 72A corresponds to a set of risers such as shown at 40A in FIG. 2. FIG. 4 shows that the umbilical tubes 72A–72G are spaced about a circle 122 of greatest diameter. The other two groups of twelve tubes each, lie on circles 124, 126 of slightly smaller diameters. Each of the circles 122–126 is of larger diameter (over 10% and usually over 20% larger) than the inside bearing diameter (D in FIG. 3) of the bearing structure. FIG. 4 also shows a group of six tubes 130 through which mooring chain devices extend.

It is desirable that the lower ends of the tubes are widely spaced apart, preferably by a distance such as one meter. Such spacing avoids the risers from rubbing on one another, and provides room for divers who must supervise the installation and provide inspections at intervals such as every several months to a few years. It is desirable that the lower ends of the tubes lie substantially on one circle so they do not lie one directly within the other, which would hamper the view and access of the divers.

Figure 5:
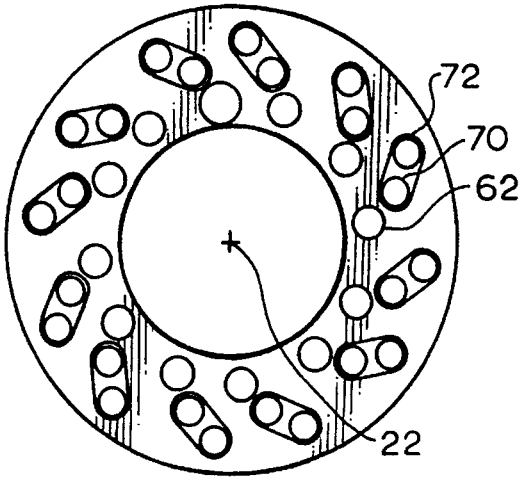
FIG. 5 is a simplified sectional view taken on line 5—5 of FIG. 3.
Figure 6:
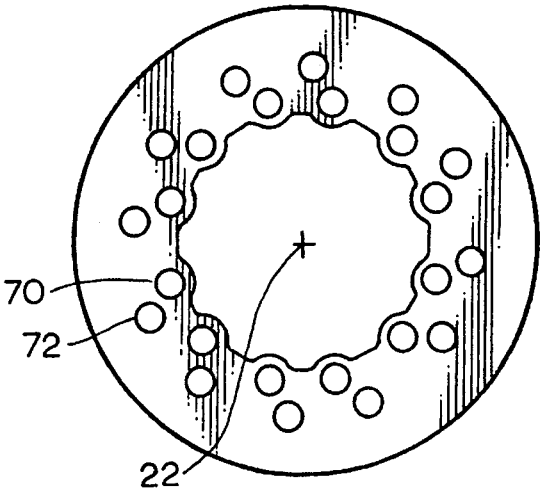
FIG. 6 is a sectional view taken on line 6—6 of FIG. 3.
Figure 7:
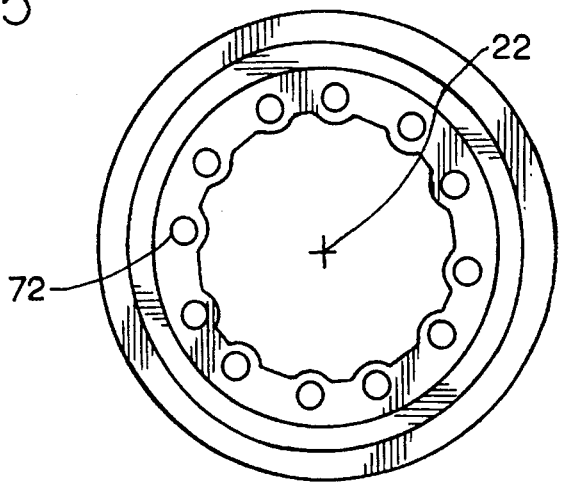
FIG. 7 is a view taken on line 7—7 of FIG. 3.

FIGS. 5, 6 and 7 show sectional views of the tubes at the different heights shown in FIG. 3 at lines 5—5, 6—6, and 7—7, showing that the tubes lie progressively closer to the turret axis 22 at progressively higher locations.

Figures 8, 9, 10, 11:
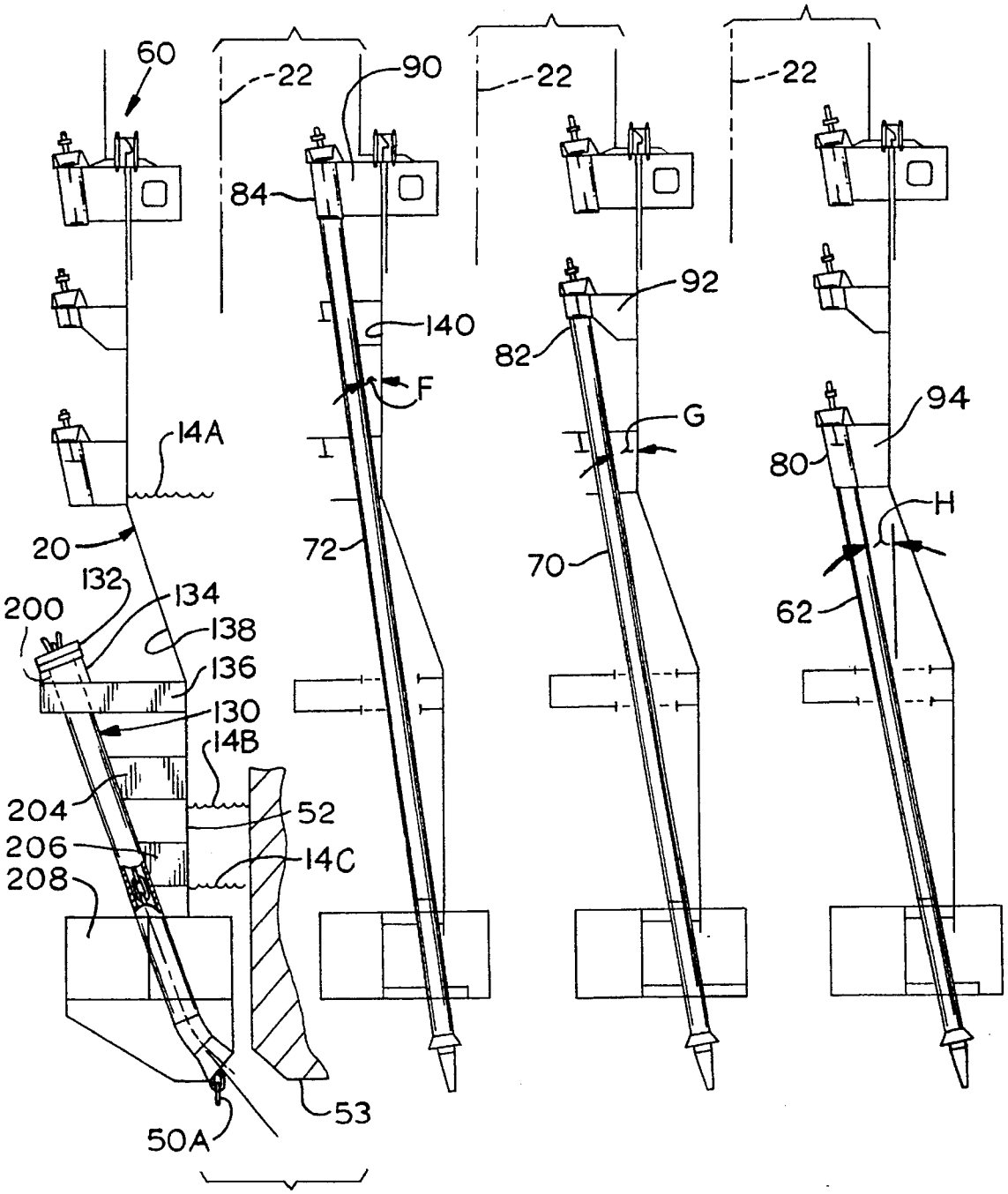
FIG. 8 is a side elevation view of a portion of the turret of FIG. 3 and of a mooring chain tube of the turret.
FIG. 9 is a side elevation view of a portion of the turret of FIG. 3 and of a hydrocarbon production tube thereof.
FIG. 10 is a partial sectional view of the turret of FIG. 3 and showing an annulus tube thereof.
FIG. 11 is a partial sectional view of the turret of FIG. 3 and of an umbilical tube thereof.

FIGS. 8–11 are side view of each of the tubes, with FIG. 8 showing one of the hawse pipes or mooring chain-holding tubes 130. It can be seen that a mooring chain device 50A extends through the tube 130 to a chain stopper 132 at the upper end of the tube. The chain stopper and the entire termination structure 134 at the top of the tube, is mounted on a deck structure 136 which is a ring-shaped structure that is mounted on the inner walls 138 of the turret cavity 20 of the vessel.

FIG. 11 shows the umbilical tube 62, showing its upper end 80 mounted on the deck structure 94, while FIGS. 10 and 9 respectively show the production and annulus tubes 70, 72 whose upper ends are mounted on the deck structure 92, 90. While the tallest tube 72 of FIG. 9 extends at an angle F of 7° from line 140 which is parallel to the turret axis, the annulus tubes 70 extend at a slightly greater angle G of 9° from the turret axis, while the shorter umbilical tubes 62 of FIG. 11 extend at an angle H of 11° from the turret axis. This results in the upper ends of the tubes all lying on circles of diameters D that are all about the same, and that are all almost as great as the inside diameter of A of the bearing structure (preferably D is at least ⅔ or 67% and is usually at least 80% of A). As shown in FIG. 3, this is important for the two longest tubes 70, 72 whose upper ends lie at or above the bottom of the bearing structure. The upper ends of the tubes 62 can lie on a larger circle. It would be possible to extend the tubes to levels above the bearing structure and then bend the tubes radially outward so the termination structures lie on a large diameter; however, this would require relatively sharp bending of the risers, which can damage them.

The tubes are preferably substantially straight in that the top and bottom of each tube preferably extend within 15° of each other and more preferably within 10° of each other. This avoids high friction and scraping of the risers (or chain device) when they are pulled through. It is desirable that the lower ends of the tubes extend at an angle of a plurality of degrees from the vertical and that the lower ends of the tubes extend parallel to the "natural" angle at which the riser upper ends would extend for the particular installation of that riser, in the quiescent position of the vessel (its position in calm seas). This lengthens the life of the riser hoses as they bend back and forth with back and forth vessel drift.

Figure 12:
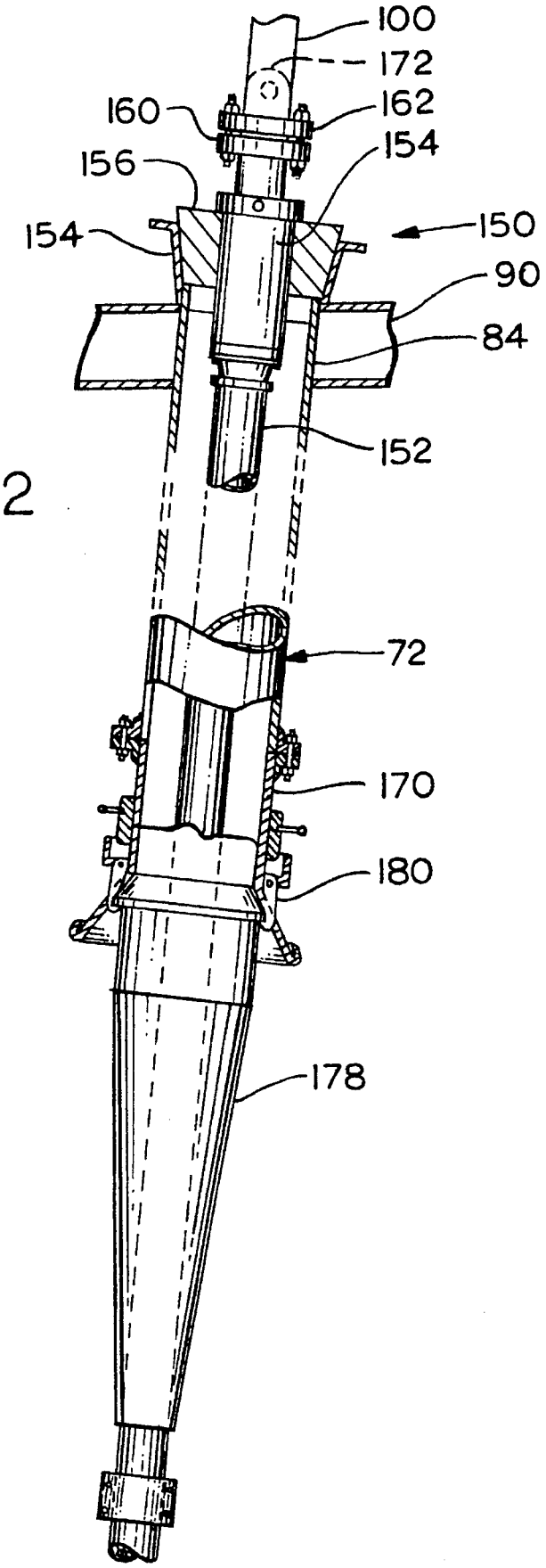
FIG. 12 is a partial sectional view of a production tube of the turret of FIG. 3.

FIG. 12 shows a termination structure 150 at the upper end 84 of the production tube 72. The termination structure mounts the upper end of the tube and of the riser 152 to the turret frame. An oil-carrying riser 152 has an upper end connected to an end fitting 154. The first or upper deck 90 carries a riser hanger 154. A split wedge 156 (preferably with three wedge parts) holds the end fitting in position. The lower end of a pipe 100 is connected through a pair of flanges 160, 162 lying respectively on the lower end of the pipe and on the upper end of the riser end fitting.

FIG. 12 also shows some details of the lower end 170 of the tube 72. The riser is initially installed with a pull-in head indicated at 172 that is initially attached to the flange 160. A cable (not shown) attached to the head is used to pull the riser up from an underwater depth through the tube 72. When a bend stiffener 178 on the riser, reaches the position shown, a clamp 180 locks it in position. The pull-in head 172 is removed and the pipe 100 is attached.

Referring to FIG. 3, it can be seen that the vessel has a fully loaded position, wherein the sea surface lies at the relative position shown at 14A. The vessel also has a 20% loaded position wherein its position relative to the sea surface is shown at 14B and at a substantially unloaded position at 14C. The turret frame has an upper portion 182 that always lies above the sea surface at 14A, and has a lower portion 184 lying below it and with a lowest part 186 lying below the height at 14B. The chains are preferably terminated at the chain deck structure 136 when the vessel is at about 20% load, so that workmen do not have to work underwater, which is hazardous because of the numerous pipes, fittings, etc. The other decks 90, 92, and 94 all preferably lie above the fully loaded sea height 14A to enable easy access throughout operation of the system. Each of the decks is preferably ring-shaped, to provide a large access area or cave 190 along which workers can move up and down along ladders 192. The size of a six foot man M is shown to indicate the relative sizes of the parts to a person.

In the present system, the upper ends of the tubes lie at different heights or at deck structures at different heights, that are usually vertically spaced apart by a plurality of meters, and the tubes are angled from the turret axis. This construction is useful where there are at least two groups of tubes that each includes at least three tubes, for passing a corresponding number of risers. This results in the upper ends of each group of at least three lying at a different height, while providing considerable room at the bottom of the turret in case maintenance work is required thereat. The bottom of the tubes lie on an imaginary circle of a diameter which at least 10% and usually at least 20% greater than the inside diameter of the bearing structure, which results in a significant advantage for the angling. Actually, since the sea floor wells are preferably spaced from the quiescent position of the vessel shown in FIG. 2, the angling of the tubes, as by the angles of 7° to 11° shown in the figures, avoids significant bending of the upper ends of the riser as they pass from below the turret and into the tubes of the turret. Of course, this system is especially valuable when there are a large number of risers and corresponding tubes, with the particular system illustrated and described above being a design for a particular field that lies in a sea depth of about one thousand meters.

FIG. 3 shows the upper ends 46AX and 46GX of two risers that extend with substantially opposite horizontal directional components, from the turret toward the sea floor. The upper ends of these two risers tend to extend at angles B of about 11° from the vertical, in the quiescent position of the vessel. The lower ends of corresponding tubes 62A, 62G are oriented to extend parallel to such "natural" directions of the riser ends. This avoids substantial bending of the risers in the quiescent condition of the vessel, so any bending of the riser end in a storm, is minimal, to thereby obtain a long riser life. Such angling of each tube lower end is desirable even where there is only one tube. The opposite tubes 62A, 62G lie on substantially opposite sides of the turret axis 22 and are oppositely inclined.

The hawse tubes 130 (FIG. 8) have upper ends 200 that lie above the sea at 14B at the 20%, or lightly loaded, vessel position. This allows workers on deck 136 to work out of the water to attach or release each chain from the chain stopper 132. The mooring chains such as 50A, transmit large forces through the chain stoppers 132 to the turret. The provision of an elongated tube 130 of a length more than five times and preferably at least ten times its inside diameter, also facilitates the transmittal of the loads to the vessel frame, as through the connectors 202, 204, and 206, in addition to the deck structure 136. The upper ends 200 of the tubes lie under water in the fully loaded vessel position when the sea is at 14A, so they do not interfere with other equipment on the turret that must be accessible.

Thus, the invention provides a turret for an offshore hydrocarbon production system, which routes a considerable number (at least six) risers so there is considerable work area around the termination structure at the upper end of each riser, while enabling the use of a turret of minimum size and weight, and while enabling the use of bearings of available size to rotatably support the turret on the vessel. The upper ends of a large number of tubes and corresponding risers can be terminated within a cylindrical area of a diameter no greater than the inside of the bearing structure, by placing the terminations at vertically spaced levels. An area of large diameter is available at the lower portion of the turret which lies underwater, to accommodate the multiple risers and tubes, by orienting the tubes so they extend at inclines to the axis, to make the tubes lie progressively closer to the axis at progressively higher tube locations, so the tubes can pass through the opening at the inside of the bearing structure. Of course, applicant places the upper ends of the tubes at about as large a diameter as can be readily accommodated for such tubes that pass up through the bearing structure. The angling of the tubes from the vertical to match the "natural" angle of the riser upper end portions, is useful even where there are a limited number of risers (even only one), to minimize bending of the riser upper end portions.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A hydrocarbon production system which includes a vessel for floating in a sea, a turret having lower and upper portions lying respectively above and below the sea surface, a bearing structure which supports said turret on said vessel in relative rotation about a substantially vertical axis, a fluid swivel coupled to said vessel, and a plurality of tubes extending primarily vertically between said turret lower and upper portions for surrounding upper portions of each of a plurality of risers extending up from the sea floor, and a plurality of pipes for coupling upper ends of at least some of said risers to said fluid swivel, characterized by:

said bearing has a predetermined bearing inside diameter;

a plurality of said tubes each extends at an incline of a plurality of degrees from said axis so higher locations along said tubes lie closer to said axis, and with said plurality of tubes having lower ends lying on an imaginary lower circle which is of a diameter that is at least 10% greater than said bearing inside diameter, and with said plurality of tubes having upper ends lying above the sea surface and at least about as high as said bearing, and lying on an imaginary upper circle which is of a diameter that is no greater than said bearing inside diameter.

2. The system described in claim 1 wherein:

each of said tubes is substantially straight, with its upper and lower ends angled not more than 15° from each other.

3. The system described in claim 1 including:

a primarily vertically-extending second plurality of tube elements for surrounding upper portions of each of another plurality of risers extending up from the sea floor, with each of said second tube elements extending at an incline of a plurality of degrees from the vertical and having upper ends lying at a level which is a distance below the level of the upper ends of said tubes.

4. The system described in claim 1 wherein:

said diameter of said upper circle is at least two-thirds of said bearing inside diameter.

5. A turret for rotational mounting about an axis on a vessel to couple at least six risers that have upper ends and that extend up from the sea floor to said turret, wherein said turret has a frame with lower and upper portions, at least six tubes extending primarily vertically between said turret frame lower and upper portions for surrounding corresponding ones of said risers, with said tubes having upper ends, and a plurality of terminating structures for mounting said tube and riser upper ends to said turret frame, characterized by:

said turret frame upper portion has a plurality of deck structures that are vertically spaced from one another, with the upper ends of at least three of said tubes and three corresponding ones of said riser upper ends and three corresponding ones of said terminating structures lying substantially at a first of said deck structures, and with the upper ends of three others of said tubes and corresponding riser upper ends and corresponding terminating structures lying substantially at a second of said deck structures which is vertically spaced from said first deck structure, to thereby provide increased room about each termination structure.

6. The turret described in claim 5 including:

a bearing structure which rotatably supports said turret on said vessel, in relative rotation about a substantially vertical axis, said bearing structure having a predetermined bearing inside diameter;

a first group of at least three of said tubes are spaced about said axis and are each angled a plurality of degrees from said axis to lie progressively closer to said axis at progressively higher locations, with said tubes of said first group having lower ends lying below said bearing structure and on an imaginary first circle that is larger than said predetermined bearing inside diameter, and with the upper ends of said tubes of said first group lying at least as high as said bearing structure and on an imaginary second circle that is smaller than said predetermined bearing inside diameter.

7. The turret described in claim 5 wherein:

said deck structures are vertically spaced by a plurality of meters, and said deck structures are constructed to leave a cave extending vertically along said axis.

8. A combination of a bearing assembly for mounting on a vessel wherein said bearing assembly has a predetermined bearing inside diameter, and a turret rotatably mounted on said bearing assembly to couple to the upper ends of each at least six risers that extend up from the sea floor, wherein said turret has a frame with lower and upper portions and at least six tubes for coupling to said risers with said tubes extending primarily vertically between said frame lower and upper portions, characterized by:

said at least six tubes include first and second groups of tubes with each group including three tubes, with the tubes of said first group having lower tube ends lying on an imaginary first lower circle that is larger than said bearing inside diameter, and with the tubes of said first group having upper tube ends lying at a first height and lying on an imaginary first upper circle that is smaller than said bearing inside diameter, and with the tubes of said second group having lower tube ends lying on an imaginary second lower circle that is larger than said bearing inside diameter and with the tubes of said second group having upper tube ends lying at a second height that is lower than said first height and lying on an imaginary second upper circle that is smaller than said bearing inside diameter.

9. The combination described in claim 8 wherein:

said first lower circle is at least 10% greater than said bearing inside diameter, said tubes are each substantially straight, and said risers extend through said tubes and have upper ends lying at substantially said tube upper ends.

10. A method for establishing an offshore hydrocarbon production system which includes at least six flexible risers extending up from the sea floor to a turret that is rotatable about a substantially vertical axis on a weathervaning vessel, which includes mounting at least two groups of primarily vertical tubes in said turret with each group including at least three tubes, pulling said risers upwardly through said tubes and mounting the upper end of each of said risers at substantially the level of the upper end of a corresponding tube, and connecting the upper end of each riser that lies in one of said groups to a pipe that is coupled to said vessel to carry fluid from the riser to said vessel; characterized by:

said step of mounting includes mounting the upper ends of tubes of a first group so they lie above the level of the upper ends of tubes of the second group.

11. The method described in claim 10 wherein:

said step of mounting at least two groups of three tubes each, includes mounting upper ends of tubes of a first group at substantially a first level and mounting upper ends of tubes of a second group at a second level that is lower than said first level; and including mounting said turret on said vessel by a bearing that has a predetermined bearing inside diameter;

locating said first and second levels so they are vertically spaced by a plurality of meters, with said first level lying above said bearing;

angling said tubes of said first group from said axis so the lower ends of said tubes of said first group lie on an imaginary circle that is at least 20% greater than said bearing inside diameter.

12. A system which includes a vessel for floating in a sea wherein the vessel has about a 20% loaded position with respect to the sea surface and a fully loaded position with respect to the sea surface, a turret having lower and upper portions, a bearing structure which supports said turret on said vessel in relative rotation about a substantially vertical axis, and a plurality of mooring chain devices that each has an upper end and a chain stopper coupling said upper end to said turret and a lower end anchored to the sea floor, characterized by:

a plurality of largely vertically-extending chain device-receiving tubes, each tube being mounted on said turret and having a lower end lying under water and an upper end, and each of a plurality of said chain device extends through one of said tubes and is connected to one of said chain stoppers with each chain stopper lying about as high as a tube upper end;

each of said upper ends of said chain device-receiving tubes lies above water in said about 20% loaded position but lies under water in said fully loaded position.

13. A system which includes a vessel for floating in a sea wherein the vessel has a substantially 20% loaded position with respect to the sea surface, a turret having lower and upper portions, a bearing structure which supports said turret on said vessel in relative rotation about a substantially vertical axis, and a plurality of mooring chain devices that each has an upper end and a chain stopper coupling said upper end to said turret and a lower end anchored to the sea floor, characterized by:

a plurality of largely vertically-extending chain device-receiving tubes, each tube being mounted on said turret and having a lower end lying under water and an upper end lying above water in said substantially 20% loaded position of said vessel, each of a plurality of said chain device extends through one of said tubes and is coupled through one of said chain stoppers to the turret, with each chain stopper lying at least about as high as a corresponding tube upper end;

said vessel has a fully loaded portion with respect to the sea surface, said chain stoppers lie below the sea surface in said fully loaded position of said vessel, and said chain stoppers each lie above the sea surface in said substantially 20% loaded position of said vessel.

* * * * *